US008057028B2

(12) United States Patent
Petranek et al.

(10) Patent No.: US 8,057,028 B2
(45) **Date of Patent: *Nov. 15, 2011**

(54) PRINTING DEVICE FLUID RESERVOIR WITH GRIPPING FEATURES

(75) Inventors: Diana C. Petranek, Hilton, NY (US); R. Winfield Trafton, Brockport, NY (US); Patricia L. Williams, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/705,687

(22) Filed: Feb. 15, 2010

(65) Prior Publication Data

US 2010/0141718 A1 Jun. 10, 2010

Related U.S. Application Data

(63) Continuation of application No. 11/614,147, filed on Dec. 21, 2006, now Pat. No. 7,690,774.

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | | |
|---|---|---|---|---|
| 5,646,654 | A | 7/1997 | Widder | |
| 6,155,678 | A | 12/2000 | Komplin et al. | |
| 6,350,025 | B1 | 2/2002 | Morita et al. | |
| 6,390,601 | B1 | 5/2002 | Morita et al. | |
| 6,623,104 | B1 | 9/2003 | Kotaki et al. | |
| 6,796,646 | B2 | 9/2004 | Komplin et al. | |
| 6,997,548 | B2 | 2/2006 | Matsuo et al. | |
| 7,008,053 | B2 | 3/2006 | Hashii et al. | |
| 7,690,774 | B2 * | 4/2010 | Petranek et al. | 347/86 |
| 2002/0033857 | A1 | 3/2002 | Ohashi et al. | |
| 2002/0175979 | A1 | 11/2002 | Morita et al. | |
| 2003/0035035 | A1 | 2/2003 | Komplin et al. | |
| 2004/0135857 | A1 | 7/2004 | Hashii et al. | |

FOREIGN PATENT DOCUMENTS

| | | |
|---|---|---|
| EP | 1 512 536 | 3/2005 |
| WO | 01/54911 | 8/2001 |

OTHER PUBLICATIONS

Canon i850 printhead and tank installation, 2 pages, documentation and photos, 2002.
HP 14 Cartridge installation instruction and photos, 3 pages, May 2001.
HP officejet d series, work with printheads and ink cartridges, pp. 59-70, 2001.

* cited by examiner

*Primary Examiner* — An H Do
(74) *Attorney, Agent, or Firm* — Peyton C. Watkins

(57) ABSTRACT

Embodiments of a printing device fluid reservoir with gripping features are disclosed. In an embodiment of the present invention, the fluid reservoir includes a first surface and a fluid-containing body located beneath the first surface. According to an embodiment of the present invention, the first surface includes a protruding grip, and the fluid-containing body has a lever extending therefrom. According to an embodiment of the present invention, both the protruding grip and the lever are configured to receive a pinching force that compresses the lever towards the fluid-containing body, facilitates carrying of the fluid reservoir, and facilitates installing and/or releasing the fluid reservoir into/from a chassis of the printing device.

4 Claims, 4 Drawing Sheets

PRINTING DEVICE FLUID RESERVOIR WITH GRIPPING FEATURES

CROSS-REFERENCE TO RELATED APPLICATIONS

This is a Continuation of application Ser. No. 11/614,147 filed Dec. 21, 2006, now U.S. Pat. No. 7,690,774 entitled "Printing Device Fluid Reservoir with Gripping Features", by Diana C. Petranek, et al.

FIELD OF THE INVENTION

This invention pertains to a printing device fluid reservoir with gripping features. In particular, this invention pertains to gripping features for a fluid reservoir that facilitate holding, insertion of, and removal of the fluid reservoir from a chassis.

BACKGROUND OF THE INVENTION

Fluid-ejection printing devices, such as ink jet printers, commonly have at least one fluid reservoir and a chassis that supports the fluid reservoir. The combination of the fluid reservoir and the chassis is referred to herein as a "fluid-providing system." The fluid reservoir may contain one or more fluid chambers that provide fluid to a printhead. If the fluid reservoir has more than one ink chamber, each such chamber often retains fluid of a different color for multi-color printing. On the other hand, if the fluid reservoir has only a single ink chamber, typically such chamber is used to retain black ink for black-and-white printing.

The printhead commonly is connected directly or indirectly to the chassis. In order to form an image, the printhead, along with the chassis and the fluid reservoir, typically are moved in a lateral direction across a width of a substrate, such as paper, as fluid is ejected from the printhead. After the printhead forms a row-portion of the image along the width of the substrate, the substrate is advanced in a direction perpendicular to the lateral direction along a length of the substrate, so that the printhead can form a subsequent row-portion of the image. This process of advancing the substrate for each row-portion is repeated until a next substrate is needed or the image is completed.

When an ink chamber in the fluid reservoir runs out of fluid, a user is charged with the responsibility of removing the empty fluid reservoir from the chassis and replacing it with a full fluid reservoir. Consequently, the task of replacing a fluid reservoir into the chassis must be simple and must consistently achieve a proper engagement of the fluid reservoir into the chassis. Otherwise, improper insertion of the fluid reservoir into the chassis may lead to damage to the printing device due to fluid leaks, may cause poorly formed images due to an improper communication of fluid from the fluid reservoir to the printhead, and may result in user frustration. Furthermore, if it is not easy for a user to insert a fluid reservoir into a chassis, or if proper installation is not apparent to the user, the user may resort to using excessive force when inserting the fluid reservoir into the chassis. In this case, excessive contact between fragile components on the fluid reservoir and/or the chassis may occur, thereby resulting in damage. Accordingly, a need in the art exists for an insertion-solution that allows a user to simply and reliably insert a fluid reservoir into a chassis of a fluid-ejecting printing device.

SUMMARY OF THE INVENTION

The above-described problems are addressed and a technical solution is achieved in the art by a printing device fluid reservoir with gripping features according to embodiments of the present invention. In an embodiment of the present invention, the fluid reservoir includes a first surface and a fluid-containing body located beneath the first surface when the fluid reservoir is in an orientation in which it is configured to operate. According to an embodiment of the present invention, the first surface includes a protruding grip, and the fluid-containing body has a lever extending therefrom. According to an embodiment of the present invention, both the protruding grip and the lever are configured to receive a pinching force that compresses the lever towards the fluid-containing body, facilitates carrying of the fluid reservoir, and facilitates installing and/or releasing the fluid reservoir into/from a chassis of the printing device. An advantage of the protruding grip and lever arrangement, according to embodiments of the present invention, is that it serves multiple purposes of carrying the fluid reservoir, installing it into the chassis, and removing it from the chassis.

According to an embodiment of the present invention, the protruding grip extends horizontally or substantially horizontally beyond an edge of the fluid containing body. According to another embodiment of the invention, the protruding grip may be flat or substantially flat, which may make the fluid reservoir easier to fit into a printing device. Further in this regard, the protruding grip and the first surface of the fluid reservoir form a single flat or substantially flat surface, which also may make the fluid reservoir easier to fit into a printing device. On the other hand, the protruding grip may be curved (along with or separate from the first surface of the fluid reservoir) to facilitate better interaction with a finger applying a pinching force. Further, the protruding grip may include a textured region to facilitate gripping and interaction with a finger applying the pinching force.

According to an embodiment of the invention, the lever extending from the fluid-containing body, may be located at least in part beneath the protruding grip when the fluid reservoir is in an orientation in which it is configured to operate. The lever may extend further from the fluid-containing body than the protruding grip does. Alternatively, the lever may extend the same or substantially the same distance from the fluid-containing body or less than the distance from the fluid-containing body than the protruding grip does. According to an embodiment of the present invention, the lever is configured to retain a finger by its shape. For example, the lever may have a pinching-force-reception region that is concave to assist it in facilitating reception of a finger applying the pinching force.

According to an embodiment of the present invention, the lever and, optionally, the chassis are formed of a material and/or are arranged in a configuration that generates an audible sound when the fluid reservoir is properly inserted into the chassis of the printing device. According to this embodiment, a user receives instant and audible feedback regarding when the fluid reservoir is properly inserted into the chassis. According to embodiments of the present invention, sensing devices may be included with the printing device to monitor and determine whether such an audible click has been produced, in order to determine whether the fluid reservoir has been properly inserted into the supporting chassis.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention provide a protruding grip and lever combination configured to receive a pinching force, by which the fluid reservoir may easily be carried, inserted into a supporting chassis, or removed from the supporting chassis. As described herein, additional features, such as a flat or substantially flat protruding grip, a curved protruding grip, texture on the protruding grip, a proper curvature of the pinching-force-application surface of the lever, and an audible click when the lever snaps into an engaged position in the chassis provide additional benefits in their own right and need not be used in combination with the other features described herein.

Figure 1:
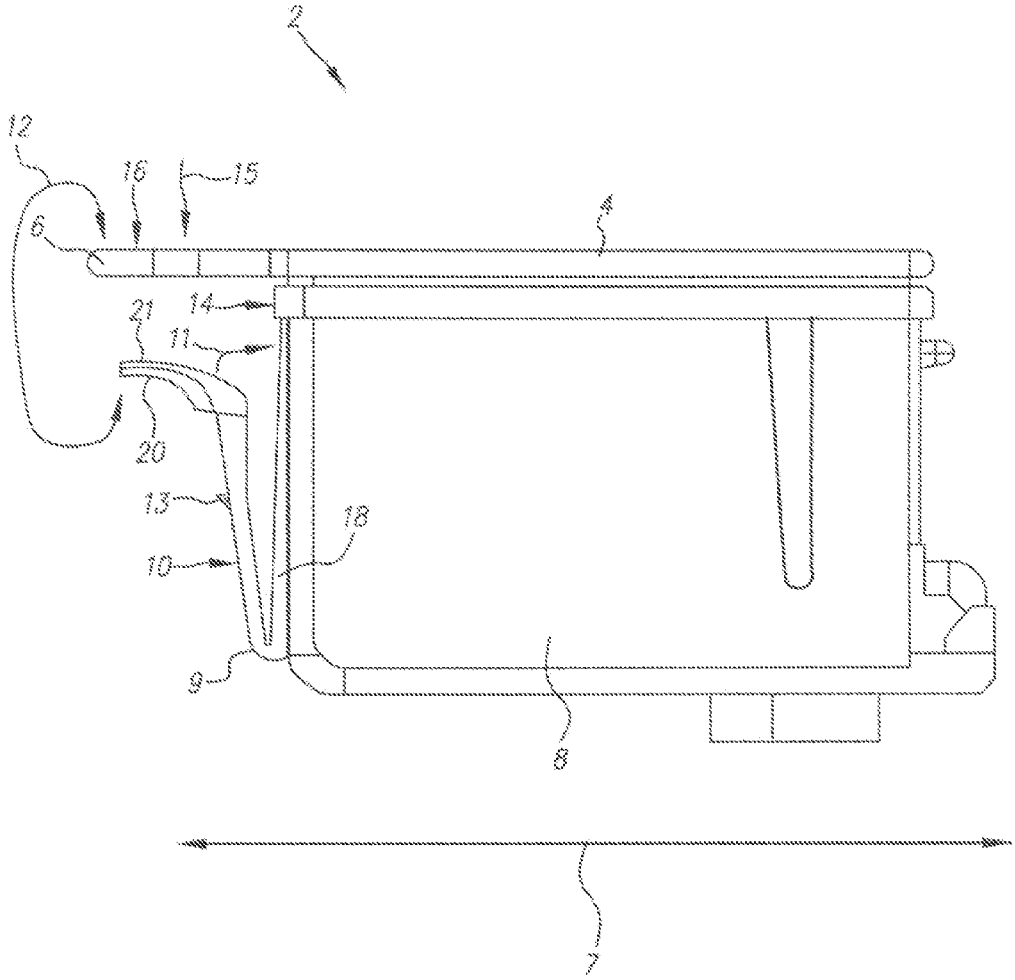
FIG. 1 illustrates a single-chamber fluid reservoir with gripping features, according to an embodiment of the present invention.

Turning now to FIG. 1, a single-chamber fluid reservoir 2, according to an embodiment of the present invention, is illustrated. Such fluid reservoir 2 includes a single, internal, fluid chamber (not shown) configured to retain fluid. In the case of ink-jet printing, the fluid chamber (not shown) may be used to retain black ink for black-and-white printing.

Also according to the embodiment of FIG. 1, the fluid reservoir 2 has a first or top surface 4 from which a grip 6 protrudes (also referred to as a "protruding grip"). The protruding grip 6, according to the embodiment of FIG. 1, extends horizontally or substantially horizontally beyond an edge 14 of the fluid-containing body 8. Although the embodiment of FIG. 1 illustrates the first surface 4 and the protruding grip 6 as forming a single flat surface, one skilled in the art will appreciate that such a configuration is not required. For instance, the protruding grip 6 may be curved in a shape that facilitates interaction with a finger applying a pinching force 12. However, a flat or substantially flat first surface 4 and protruding grip 6 may be beneficial in certain implementations and may improve the ease in which the fluid reservoir 2 fits inside a printing device (not shown).

According to the embodiment of FIG. 1, the fluid reservoir 2 includes a fluid-containing body 8 that is located beneath the first surface 4 when the fluid reservoir 2 is oriented in a configuration in which the fluid reservoir 2 is designed to operate. In the embodiment of FIG. 1, the fluid reservoir 2 is configured to be oriented in a horizontal direction 7 while operating, i.e., such that the top surface 4 is substantially aligned along a horizontal direction 7. Also according to the embodiment of FIG. 1, a lever 10 extends from a surface 18 of the fluid-containing body 8 at a point of attachment 9. The combination of the protruding grip 6 and the lever 10 are configured to receive the pinching force 12 to facilitate carrying the fluid reservoir 2, inserting the fluid reservoir 2 into a chassis 24 (shown in FIGS. 3 and 4), and removing the fluid reservoir 2 from the chassis 24. In this regard, although not required, a pinching-force-application portion 21 of the lever 10 may be curved concavely so that it approaches being parallel or substantially parallel to protruding grip 6, in order to facilitate receiving a finger applying the pinching force 12. As a result, although a portion of lever 10 is perpendicular or substantially perpendicular to top surface 4, a region of pinching-force-application portion 21 is parallel or substantially parallel to top surface 4. In addition, pinching-force-application surface 20 of portion 21 may be textured or otherwise provided with a friction-inducing surface, such as, for example, a tacky surface or elastomeric surface, for more reliable gripping. Further in this regard, although not required, the protruding grip 6 may have region 16 thereon, such that region 16 may facilitate interaction with a finger applying the pinching force 12 thereon. Like surface 20, region 16 may be textured or otherwise provided with a friction-inducing surface for more reliable gripping. Alternatively, or in combination with a textured surface, region 16 may be located in a depression in protruding grip 6. Herein the term finger is used generically and may refer to either a finger or a thumb. Typically the thumb would be applied to protruding grip 6 and the index finger would be applied to pinching-force-application surface 20, but other gripping arrangements are possible, so the word finger is used here as well as in the claims.

According to the embodiment of FIG. 1, the combination of the protruding grip 6 and the lever 10 are configured to receive a pinching force 12 in a direction perpendicular or substantially perpendicular to the protruding grip 6 and the pinching-force-application surface 20. Further, the combination of the protruding grip 6 and the surface 20 of lever 10 may be configured to receive a pinching force 12 in a direction parallel or substantially parallel to an initial direction 25 in which the fluid reservoir 2 is removed from a chassis 24 (see FIGS. 3 and 4). An advantage of this arrangement is that it allows a user to apply the pinching force 12 and then lift the fluid reservoir 2 in the initial direction 25 to remove it from the chassis 24 while the protruding grip 6 and the lever 10 support the lifting motion.

Upon application of the pinching force 12, the lever moves in a direction 11 towards surface 18 of the fluid-containing body 8. Such movement, when the fluid reservoir 2 is installed into the chassis 24, releases a latch 13, thereby disengaging the fluid reservoir 2 from the chassis. Upon insertion of the fluid reservoir 2 into the chassis 24, a downward pressure 15 applied to the protruding grip 6 causes the lever 10, and its latch 13 to snap into an engaged position in the chassis 24, (illustrated in detail below). Typically downward pressure 15 is applied after pinching force 12 is released. Such engagement causes an audible sound, such as a click sound, described in more detail below. When carrying the fluid reservoir 2 in an orientation with surface 4 at the top, according to an embodiment of the present invention, an upward force is applied to portion 21 of lever 10. In order to facilitate carrying fluid reservoir 2 without it slipping out of the hand, the region of portion 21 of lever 10 that is substantially parallel or substantially parallel to protruding grip 6 preferably is designed to extend a minimum of 4 mm in a direction that is perpendicular or substantially perpendicular to surface 18. In addition, when lever 10 is not pinched, portion 21 is designed to extend a minimum distance of 10 mm from surface 18, including the gap between lever 10 and surface 18.

Figure 2:
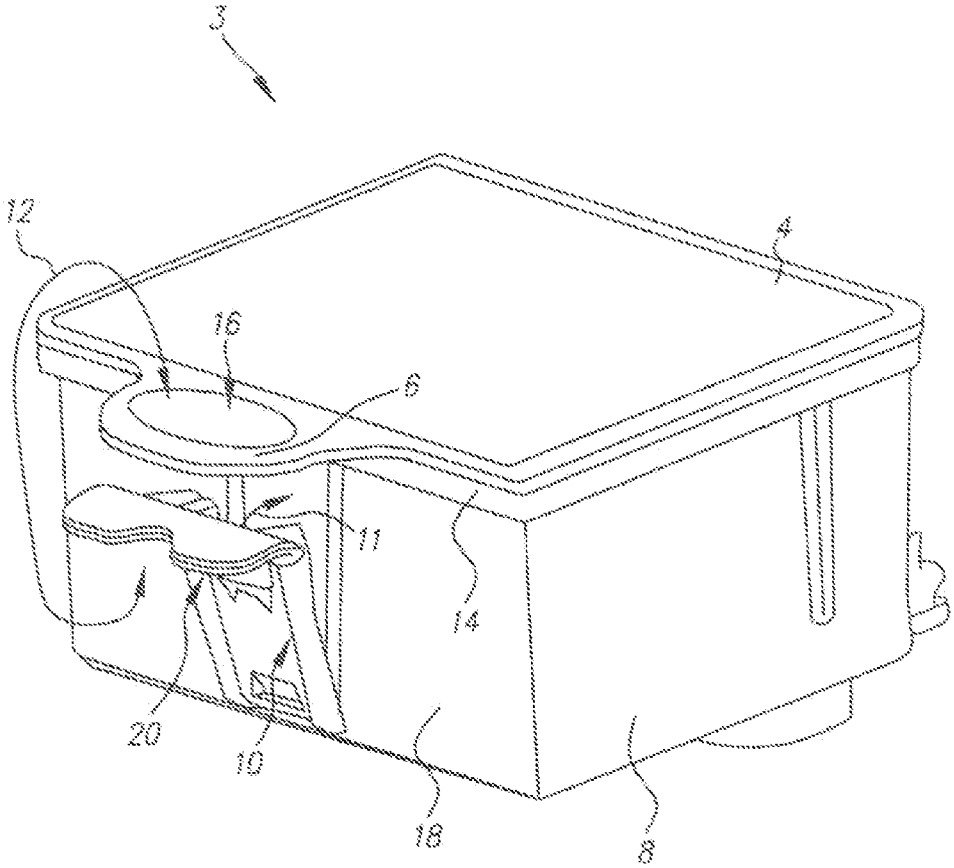
FIG. 2 illustrates a multi-chamber fluid reservoir with gripping features, according to an embodiment of the present invention.

Turning now to FIG. 2, a multi-chambered fluid reservoir 3, according to an embodiment of the present invention, is illustrated. The embodiment of FIG. 2 uses the same reference numerals to indicate same or similar features. According to the embodiment of FIG. 2, the multi-chambered fluid reservoir 3 includes the same or similar features as the singlechambered fluid reservoir 2 in FIG. 1, except that the multi-chambered fluid reservoir 3 is wider and includes multiple separate chambers (not shown), each for retaining its own supply of fluid. For example, if the fluid reservoir 3 were a multi-chambered ink tank used with an ink jet printer, each chamber (not shown) may be used to retain cyan, magenta, yellow, and black inks, respectively, for multi-color printing.

According to both embodiments of FIG. 1 and FIG. 2, the top surface 4 and protruding grip 6 may consist of a lid or cover which is affixed to fluid containing body 8. In such a case, the lid 4,6 may be affixed to body 8 by welding or adhesive prior to filling body 8 with fluid.

Figure 3:
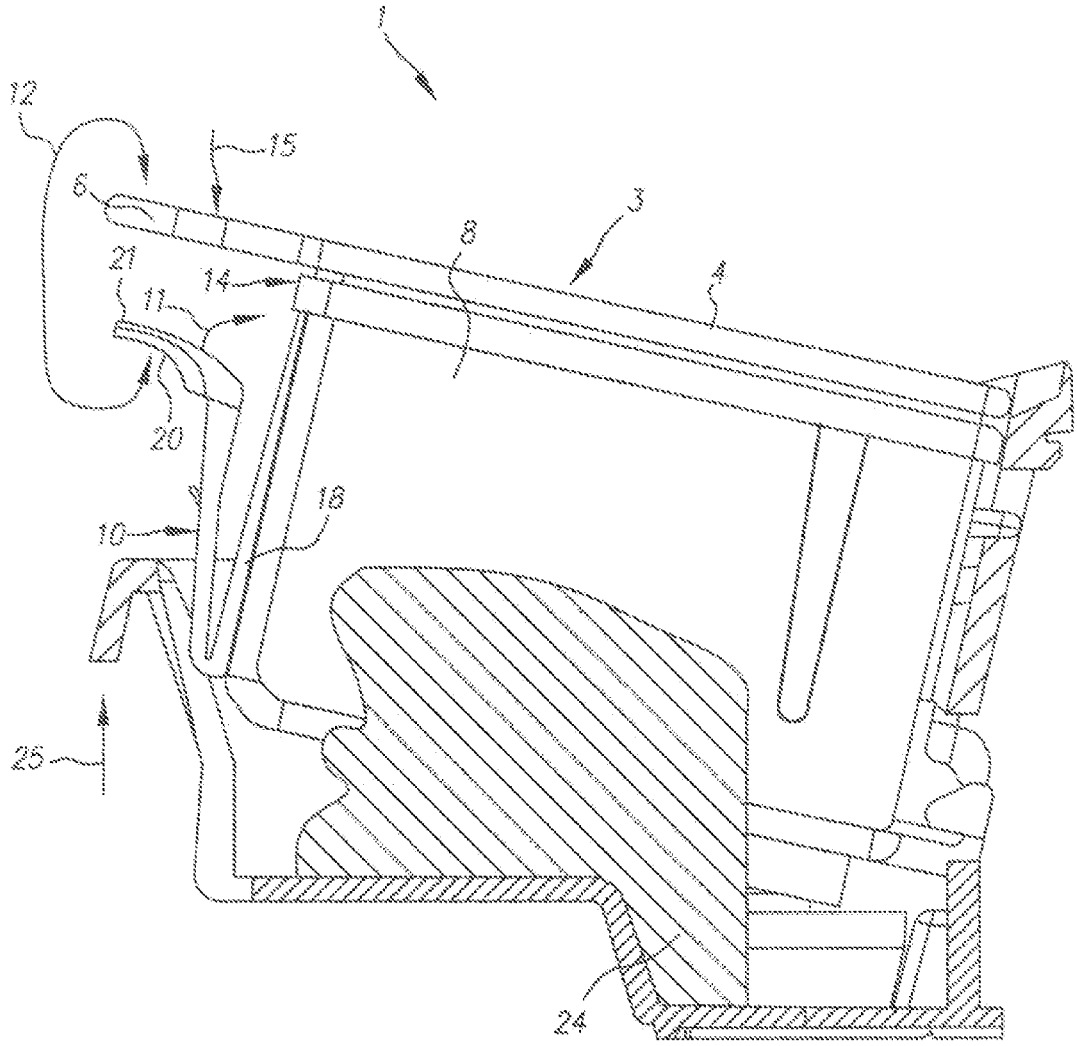
FIG. 3 illustrates a fluid reservoir just prior to proper insertion into a supporting chassis, according to an embodiment of the present invention.
Figure 4:
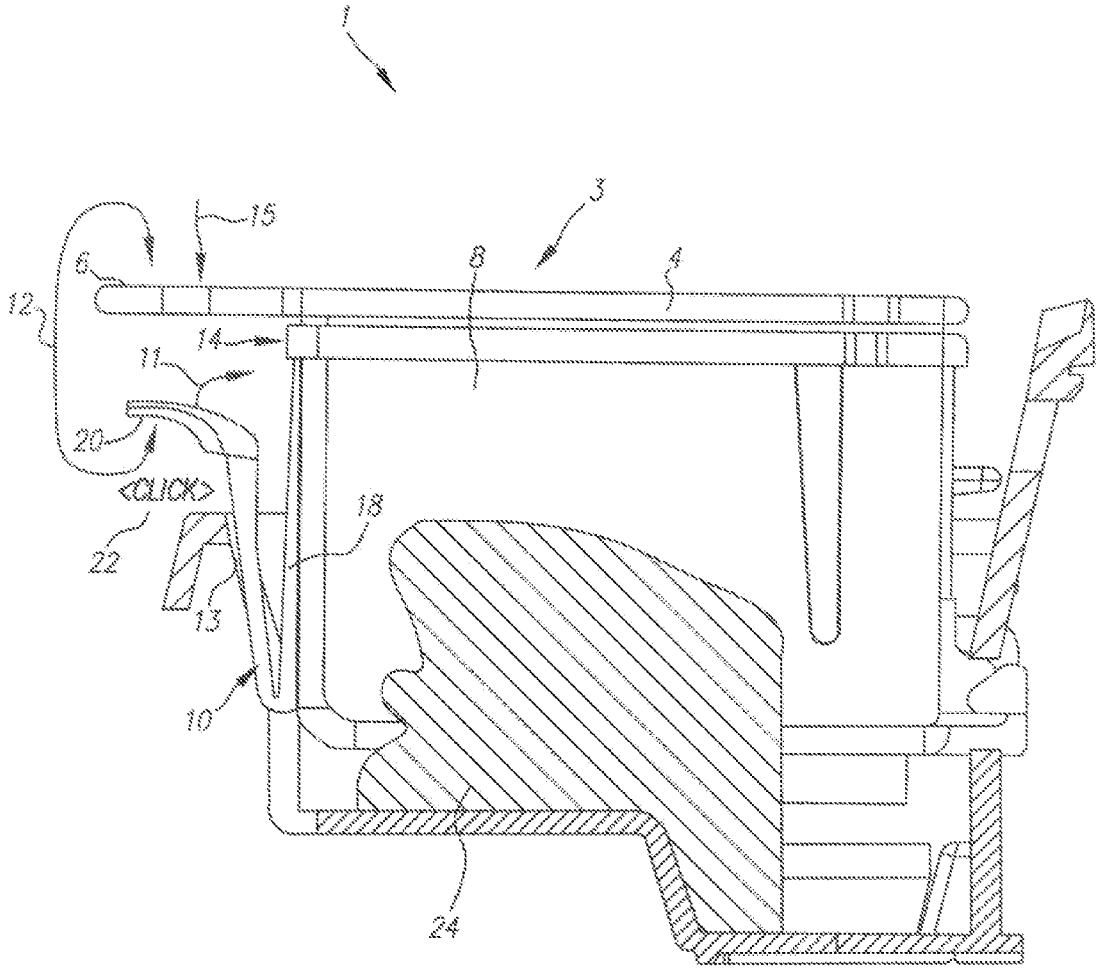
FIG. 4 illustrates a fluid reservoir properly inserted into a supporting chassis, according to an embodiment of the present invention.

FIGS. 3 and 4 illustrate a fluid-providing system 1, according to an embodiment of the present invention. When viewed in sequence, FIGS. 3 and 4 illustrate the insertion of the multi-chambered fluid reservoir 3 into the chassis 24, according to an embodiment of the present invention. In this sequence, the pinching force 12 may be applied to the protruding grip 6 and the lever 10 to carry the fluid reservoir 3 to the position shown in FIG. 3. Thereafter, the lever 10 need not be depressed, and a downward pressing force 15 may be applied to the protruding grip 6 to push the fluid reservoir 3 into the chassis 24. After application of the pressing force 15, the fluid reservoir 3 engages into the chassis 24 as shown in FIG. 4. Such engagement causes an audible sound, such as a click sound 22, when the latch 13 is engaged with the chassis 24. It should be noted that FIG. 4 represents the fluid reservoir 3 inserted into the chassis 24, and not all of the forces or sounds are applicable at the same time. When fluid reservoir 3 is being inserted as in FIG. 3, the pinching force 12 is applied, but when the fluid reservoir 3 engages in the chassis 24 as shown in FIG. 4, the pinching force 12 is typically released and the pressing force 15 is applied. The reason FIG. 4 shows pinching force 12 is that this is the force required when removing fluid reservoir 3 from chassis 24. At this time, there is no pressing force 15 applied and a less loud sound results as the latch is disengaged. According to embodiments of the present invention, the lever 10 is made of a material and has a configuration that produces an audible click sound 22 According to an embodiment of the present invention the chassis 24 is made of a relatively stiff plastic that is injection moldable, such as glass-filled polyphenylene oxide. Fluid reservoir 3 and its attached lever 10 are preferably injection molded from a single plastic material such as polypropylene.

In order to remove the fluid reservoir 3 from the chassis 24, according to an embodiment of the present invention, the pinching force 12 is applied to the protruding grip 6 and the pinching-force-application surface 20 of the lever 10 to compress the lever 10 towards the fluid containing body 14, thereby releasing the latch 13 from the chassis 24. Such release allows the fluid reservoir 3 to be removed from the chassis 24.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

1 Fluid-providing system
2 Fluid reservoir
3 Multi-chamber fluid reservoir
4 First surface
6 Protruding grip
8 Fluid-containing body
9 Attachment point
10 Lever
11 Direction
12 Pinching force
13 Latch
14 Edge
15 Downward Pressure
16 Texture
18 Surface of a fluid-containing body
20 Surface
21 Portion of lever
22 Click
24 Chassis
25 Direction

What is claimed is:

1. A fluid reservoir configured to provide image-forming fluid for a printing device, the fluid reservoir comprising:

a first surface, a second surface and at least one third surface extending between the first surface and the second surface;

a fluid-containing body located beneath the first surface when the fluid reservoir is in an orientation in which the fluid reservoir is configured to operate; and a compressible lever extending from the third surface in a direction from the second surface to the first surface; wherein, when the fluid reservoir is removed, the lever is compressed to move towards the fluid-containing body.

2. The fluid reservoir of claim 1, wherein the lever is compressed to move towards the fluid-containing body when the fluid reservoir is inserted into a chassis.

3. The fluid reservoir of claim 1, wherein the lever is configured, when inserted into a chassis, to produce an audible sound when the fluid reservoir is properly inserted into the chassis.

4. The fluid reservoir of claim 1, wherein a first portion of the lever is substantially perpendicular to the first surface.

* * * * *